US009784492B2

(12) United States Patent
Little et al.

(10) Patent No.: US 9,784,492 B2
(45) Date of Patent: Oct. 10, 2017

(54) DEVICE AND METHOD FOR PRODUCING CLEAR ICE SPHERES

(71) Applicant: Wintersmiths, LLC, Shelburne, VT (US)

(72) Inventors: Patrick William Little, Vienna, VA (US); Christopher Terence Little, Shelburne, VT (US)

(73) Assignee: Wintersmiths, LLC, Shelburne, VT (US)

( * ) Notice: Subject to any disclaimer, the term of this patent is extended or adjusted under 35 U.S.C. 154(b) by 347 days.

(21) Appl. No.: 14/309,480

(22) Filed: Jun. 19, 2014

(65) Prior Publication Data

US 2015/0027142 A1 Jan. 29, 2015

Related U.S. Application Data

(60) Provisional application No. 61/857,608, filed on Jul. 23, 2013.

(51) Int. Cl.

| | |
|---|---|
| ***F25C 1/00*** | (2006.01) |
| ***F25C 1/18*** | (2006.01) |
| ***F25C 1/22*** | (2006.01) |

(52) U.S. Cl.

CPC ..... *F25C 1/18* (2013.01); *F25C 1/22* (2013.01); *F25D 2500/02* (2013.01)

(58) Field of Classification Search

CPC ..... F25C 1/18; F25C 1/22; F25C 2600/04; F25C 1/04; F25C 1/225; F25C 1/24; F25D 2500/02

See application file for complete search history.

(56) References Cited

U.S. PATENT DOCUMENTS

| | | | | |
|---|---|---|---|---|
| 5,297,394 | A | 3/1994 | Frohbieter et al. | |
| 5,884,490 | A | 3/1999 | Whidden | |
| 6,357,720 | B1 * | 3/2002 | Shapiro | F25C 1/10 249/119 |
| 6,857,277 | B2 * | 2/2005 | Somura | F25C 1/18 249/92 |
| 6,935,124 | B2 | 8/2005 | Takahashi et al. | |
| 9,273,891 | B2 * | 3/2016 | Boarman | F25C 5/04 |
| 2009/0152438 | A1 * | 6/2009 | Chu | F25C 1/24 249/83 |

* cited by examiner

*Primary Examiner* — Allen Flanigan
*Assistant Examiner* — Filip Zec
(74) *Attorney, Agent, or Firm* — Downs Rachlin Martin PLLC

(57) ABSTRACT

Exemplary embodiments of a device and method for making clear ice spheres employing a large half mold (11) releasably connected to a small half mold (30), and an insulated vessel (70). When the device is filled with liquid and submitted to freezing temperatures the liquid freezes from the top down leaving a clear ice sphere in the mold.

17 Claims, 9 Drawing Sheets

DEVICE AND METHOD FOR PRODUCING CLEAR ICE SPHERES

CROSS-REFERENCE TO RELATED APPLICATIONS

This application claims the benefit of provisional patent application No. 61/857,608 filed 2013 Jul. 23 by the present inventors.

BACKGROUND

Prior Art

The present invention relates to the creation of clear ice spheres. Standard ice cubes are opaque and melt quickly in beverages resulting in a warm drink with a watered down taste. Clear ice spheres can ameliorate both problems. Crystal clear ice making devices available today produce clear ice primarily using one of three methods, each with their own drawbacks:

The first method freezes water layer by layer either by spraying water layers as with U.S. Pat. No. 6,857,277 or by slowly adding small amounts of water as with U.S. Pat. No. 6,935,124. The layers of water are too thin to trap impurities and gasses as they freeze and each layer of clear ice builds on the one before it to create a clear ice shape. Unfortunately, this process requires expensive, specialized equipment and machinery; further, the product available to most consumers is integrated into high-end refrigerators and only makes ice cubes.

The second method agitates the water as it freezes, typically by circulating the water as with U.S. Pat. No. 5,884,490. This approach keeps gasses from dissolving in the solution and prevents formation of the outer shell of ice that traps gasses in the ice as it freezes. As with the first method, agitation requires expensive, complex equipment to agitate the water with either a gas or mechanical device. Its primary application is with large ice sculpture molds, but it is neither practical nor economical for small consumer products such as clear ice spheres.

The third method freezes water from the inside out using "refrigerated supports" as with U.S. Pat. No. 5,297,394. This approach pushes oxygen and impurities out into the unfrozen water as it freezes outwards from the supports. The method allows commercial entities to produce large quantities of ice, but once again it requires expensive equipment and refrigeration technology; furthermore, the method can only produce hollow cylindrical tubes of ice (commonly seen in bags of ice "cubes" at convenience stores and supermarkets). These hollow tubes melt very quickly diluting any beverage they cool, unlike ice spheres.

Each of the existing means of producing clear ice requires costly, complicated, machinery to produce clear ice and in some cases cannot produce ice spheres at all. The products on the market designed for consumer use do not fare much better. Simple rubber ice ball molds allow ice to freeze from the outside in on all sides trapping impurities and gases and producing a cloudy product (albeit at low cost). Aluminum or copper ice presses stamp out clear ice balls, but require the consumer to purchase blocks of clear ice from a commercial vendor or other source (all at exorbitant cost). There are even vendors who will deliver clear ice spheres in freezer packs for a hefty cost.

None of the consumer-level ice sphere products on the market today produce their own clear ice and the existing methods of producing clear ice are too costly and complicated for consumer-level application. There is a need for a device that produces crystal clear ice spheres easily and cost effectively.

SUMMARY

In accordance with one exemplary embodiment a device for producing clear ice spheres comprises a plurality of releasably connected molds and an insulated vessel.

DRAWINGS

Figures

DRAWINGS

Reference Numerals

Figure 1:
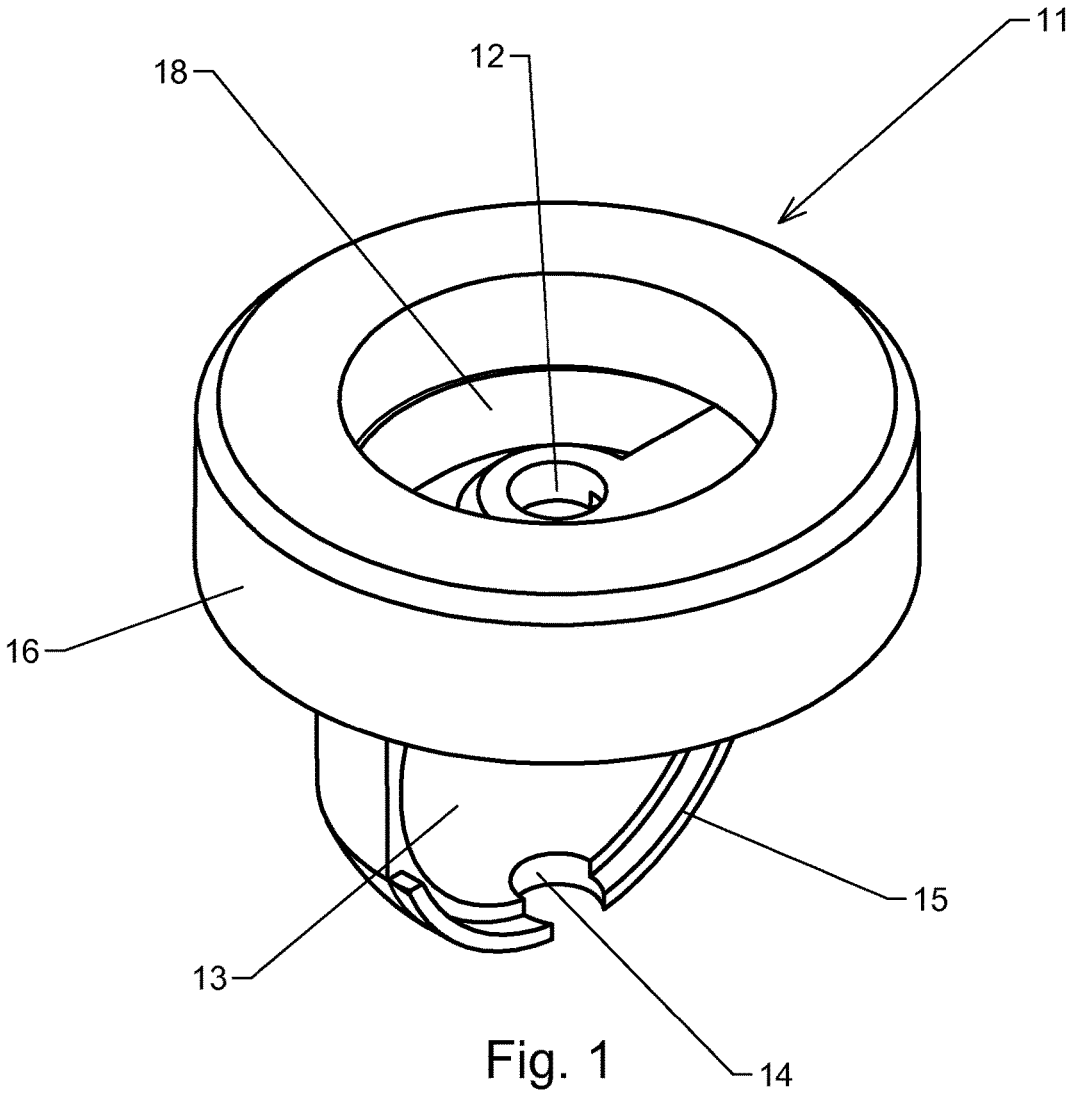
FIG. 1 is a right side perspective view of the top of an exemplary embodiment of the Large Mold Assembly.

11 Large half mold
12 Large half mold fill hole
13 Large half mold semi-spherical cavity
14 Large half mold exit hole
15 Outer flange
16 Cap
17 DELETED
18 Overflow cavity
30 Small half mold
31 Small half mold fill hole
32 Inner flange
33 Small half mold exit hole
34 Small half mold semi-spherical cavity
35 DELETED
50 Cup
51 Cup cavity
52 DELETED
60 Cup exit hole
70 Insulated Vessel
71 Vessel cavity
72 DELETED

DETAILED DESCRIPTION

First Embodiment—FIGS. 1-10

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Broadly, an embodiment of the present invention provides a device and method for producing clear ice shapes that may include two half molds that fit together; a cup with a cavity wherein two half molds may be placed inside of the cavity; and an insulated vessel wherein the cup and half molds may be placed inside the upper portion of the insulated vessel leaving a hollow space in the lower portion.

Figure 2:
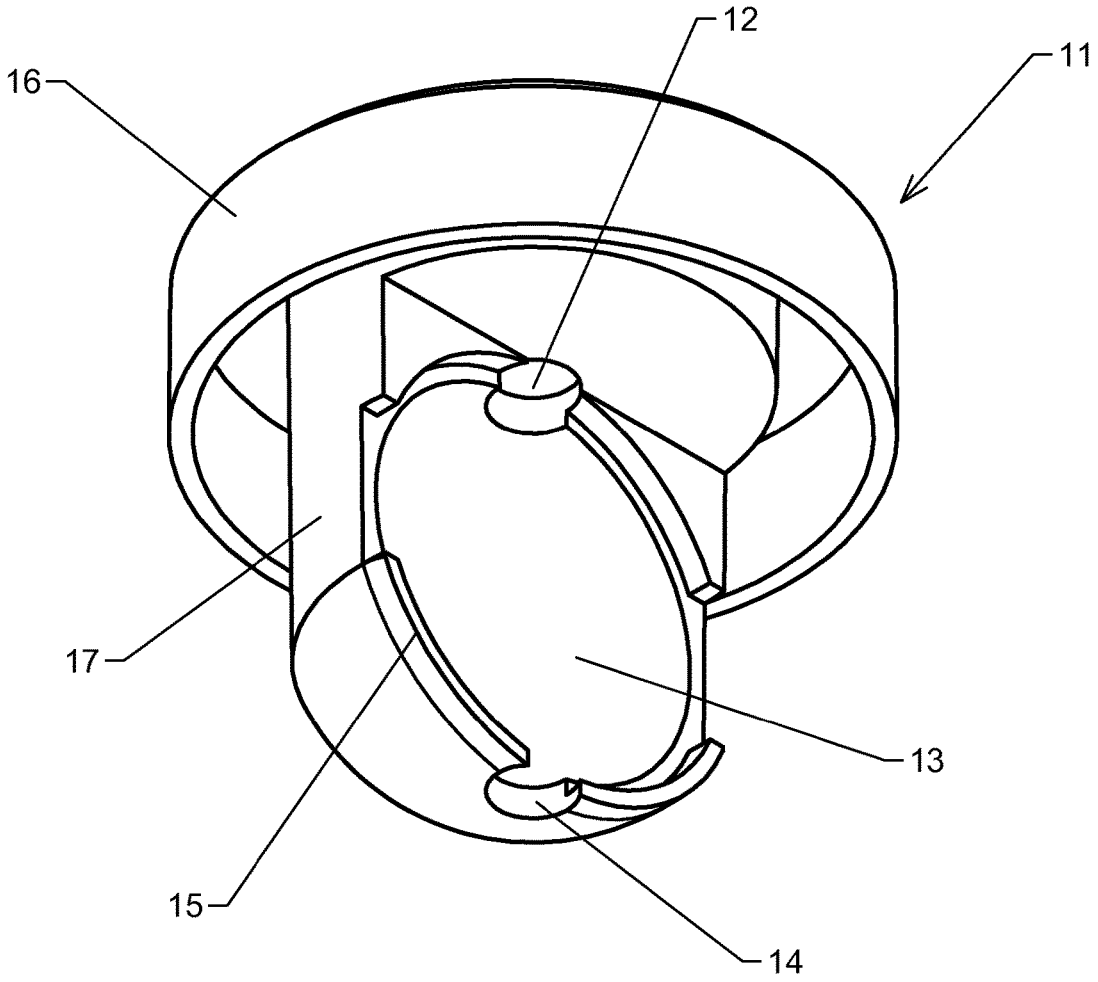
FIG. 2 is a right side perspective view of the bottom of an exemplary embodiment of the Large Half Mold.

One exemplary embodiment of the large half mold 11 is illustrated in FIGS. 1 and 2. Large half mold 11 is made from a material rigid enough to grip and turn with minimal compression or distortion. One exemplary embodiment is made with plastic, but numerous materials are possible. FIGS. 1 and 2 show large half mold fill hole 12 which is below the top of cap 16, but above overflow cavity 18, preventing excess liquid from spilling over the of the device. Large half mold fill hole 12 connects to large half mold semi-spherical cavity 13 which connects to large half mold exit hole 14 at the center of the bottom of large half mold 11. Large half mold semi-spherical cavity 13 has outer flange 15 extending from its face.

Figure 3:
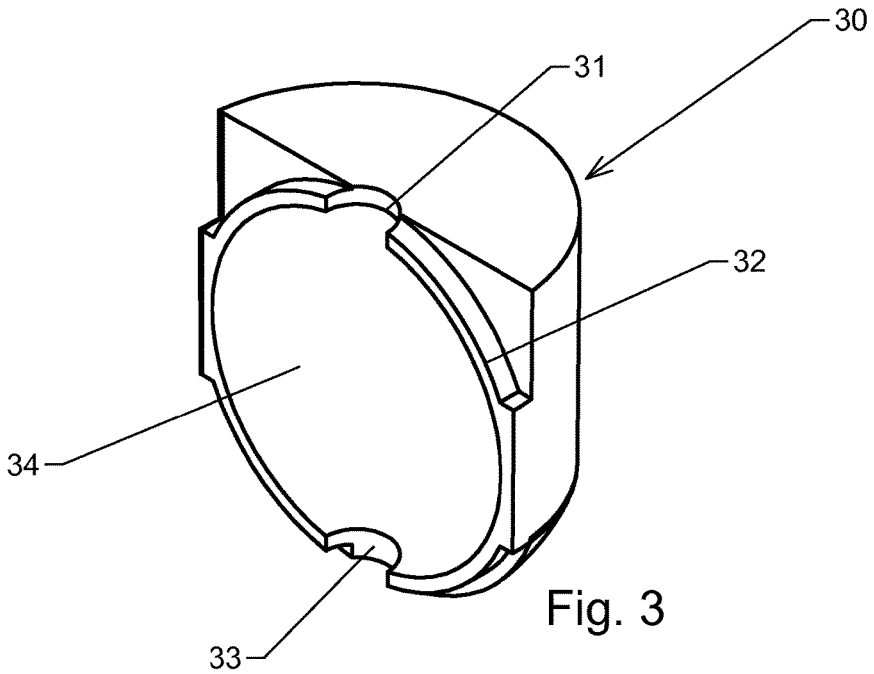
FIG. 3 is a left side perspective view of the top of an exemplary embodiment of the Small Half Mold.
Figure 4:
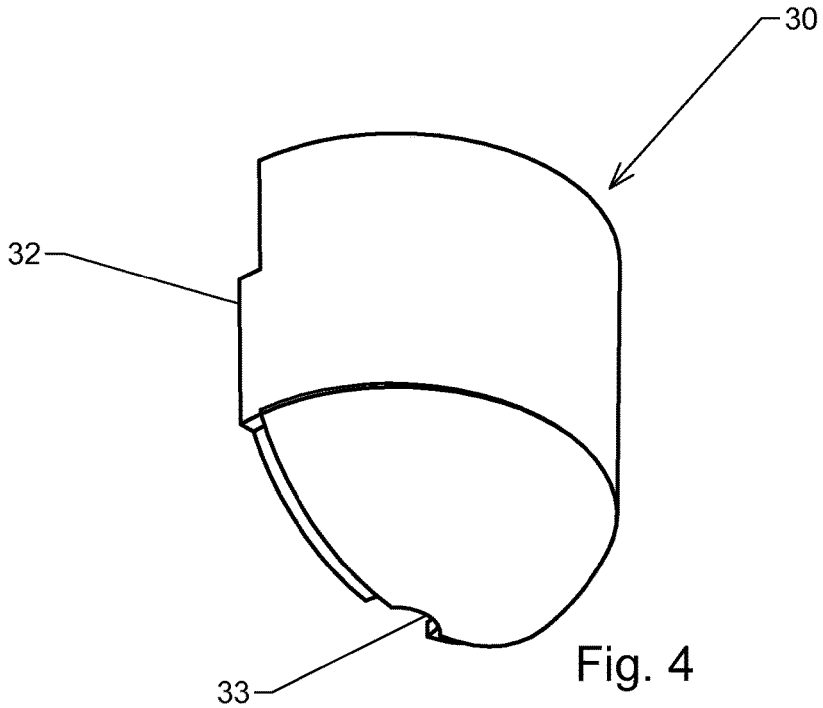
FIG. 4 is a right side perspective view of the bottom of an exemplary embodiment of the Small Half Mold.

FIGS. 3 and 4 illustrate an exemplary embodiment of small half mold 30 which may be made from a material more flexible than large half mold 11; one exemplary embodiment is made with silicone rubber, but numerous materials are possible. FIGS. 1 and 2 show small half mold fill hole 31 connecting to small half mold semi-spherical cavity 34 which then connects to small half mold exit hole 33 at the center of the bottom of small half mold 30. Inner flange 32 extends from the face of small half mold semi-spherical cavity 34.

Figure 5:
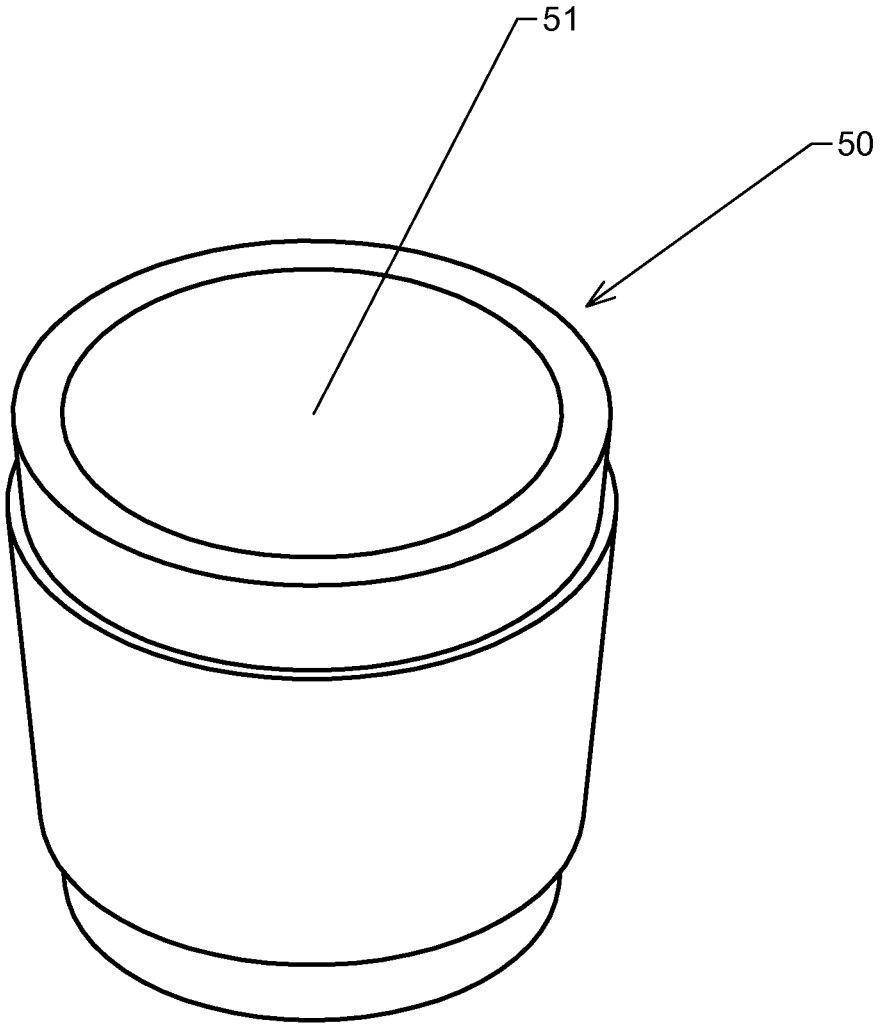
FIG. 5 is a right side perspective view of the top of an exemplary embodiment of the Cup.
Figure 6:
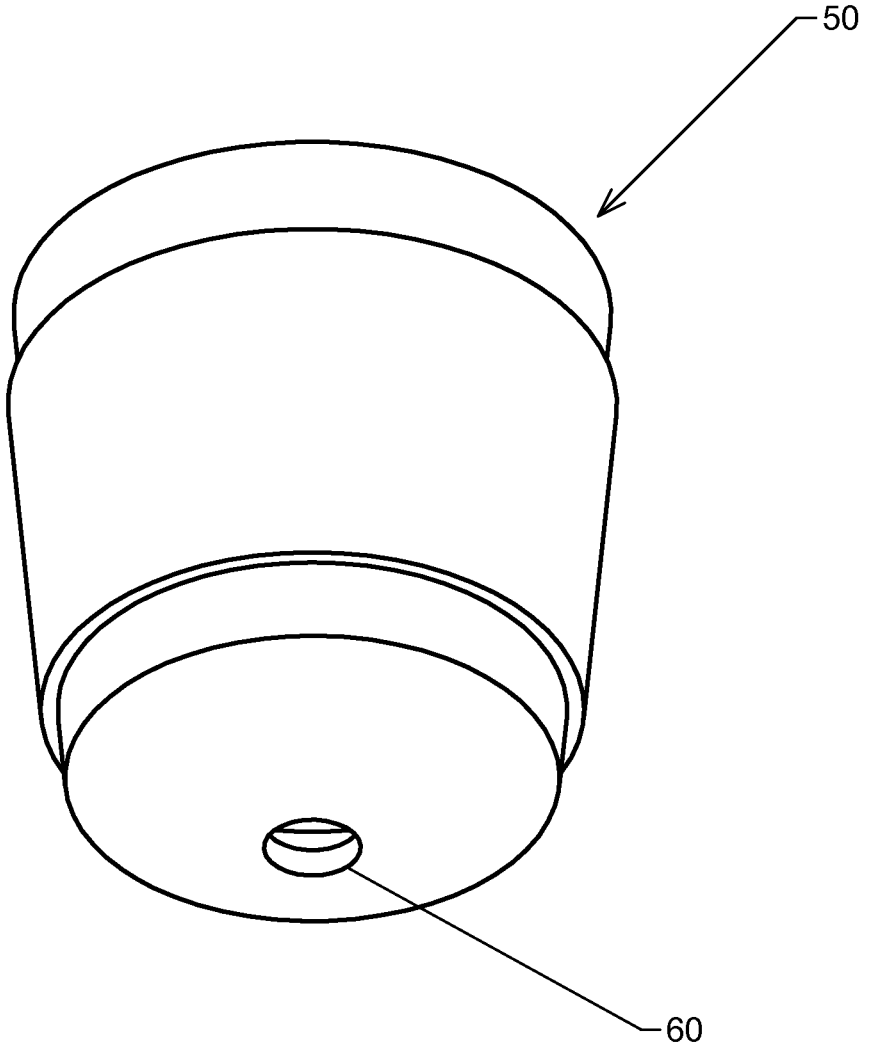
FIG. 6 is a right side perspective view of the bottom of an exemplary embodiment of the Cup.

Cup 50 is illustrated in FIGS. 5 and 6 and is made from a flexible material; one exemplary embodiment is made from silicone rubber that is more flexible than small half mold 30. FIG. 5 shows cup cavity 51 which is the same shape and depth as small half mold 30 and the lower section of large half mold 11 when the molds are mated together to prevent the two half molds from being forced apart as liquid freezes in the spherical cavity they create. FIG. 6 shows cup exit hole 60 at the center of the bottom of cup 50 connecting to cup cavity 51 (not visible in FIG. 6) and aligning with small half mold exit hole 33 and large half mold exit hole 14.

Figure 7:
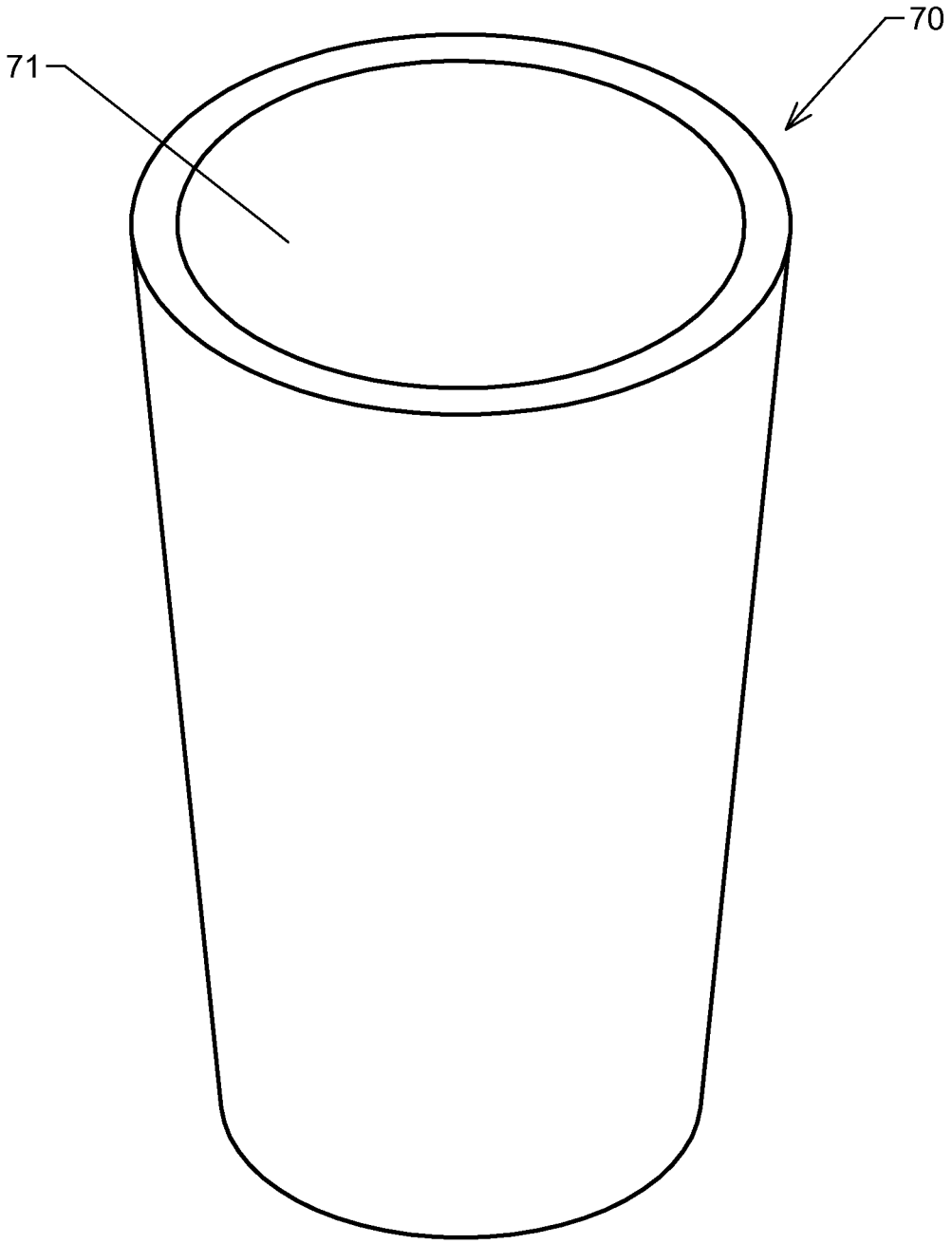
FIG. 7 is a right side perspective view of the top of an exemplary embodiment of the Insulated Vessel.

FIG. 7 illustrates an exemplary embodiment of insulated vessel 70 which can be made from any material with insulating properties. One exemplary embodiment is made with a double-walled stainless steel insulated vessel similar to travel mugs used to maintain the temperature of hot or cold liquids, but numerous other materials are possible. FIG. 7 shows insulated vessel cavity 71 which is the same shape as cup 50, but extends deeper than the bottom of cup 50. One exemplary embodiment is roughly 7 inches deep to produce an ice ball roughly 2.4 inches in diameter in air temperature of 0 degrees Fahrenheit, but the depth of insulated vessel 70 may vary to produce clear ice depending on ice ball size and air temperature among others. Insulated vessel 70 has a solid bottom (i.e. there is no exit hole as with cup 50, small half mold 30 or large half mold 11).

Figure 8:
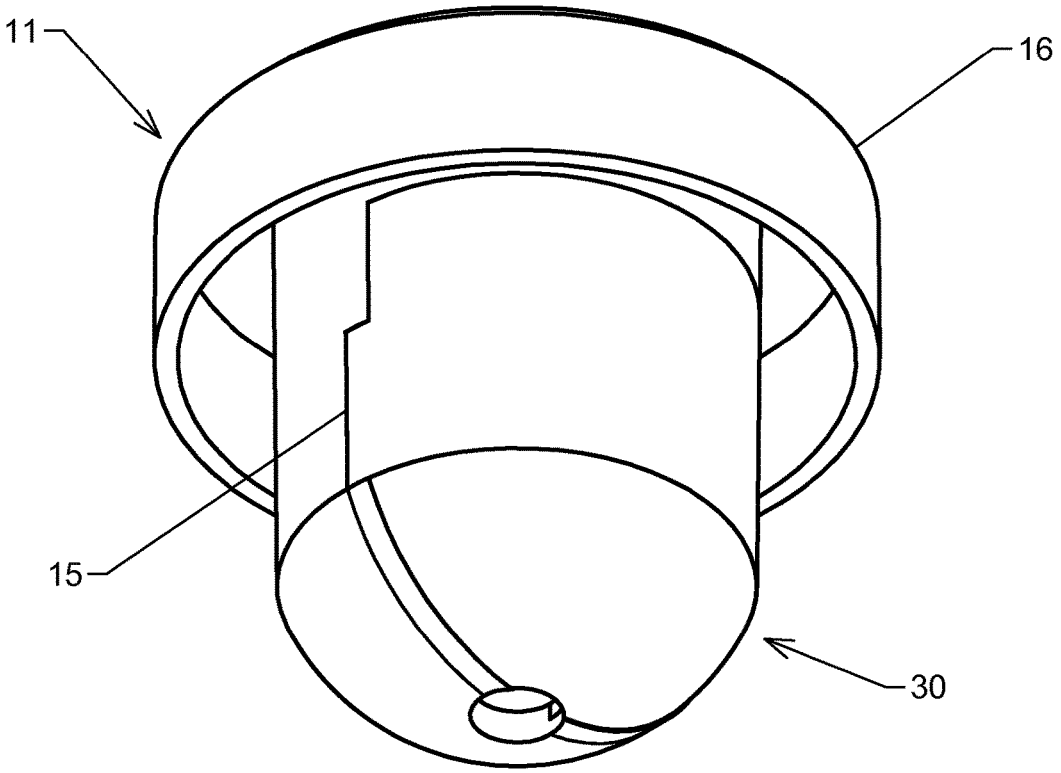
FIG. 8 is a right side perspective view of the bottom of an exemplary embodiment of the Large Half Mold and a left side perspective of the bottom of an exemplary embodiment of the Small Half Mold showing the two half molds assembled together.
Figure 9:
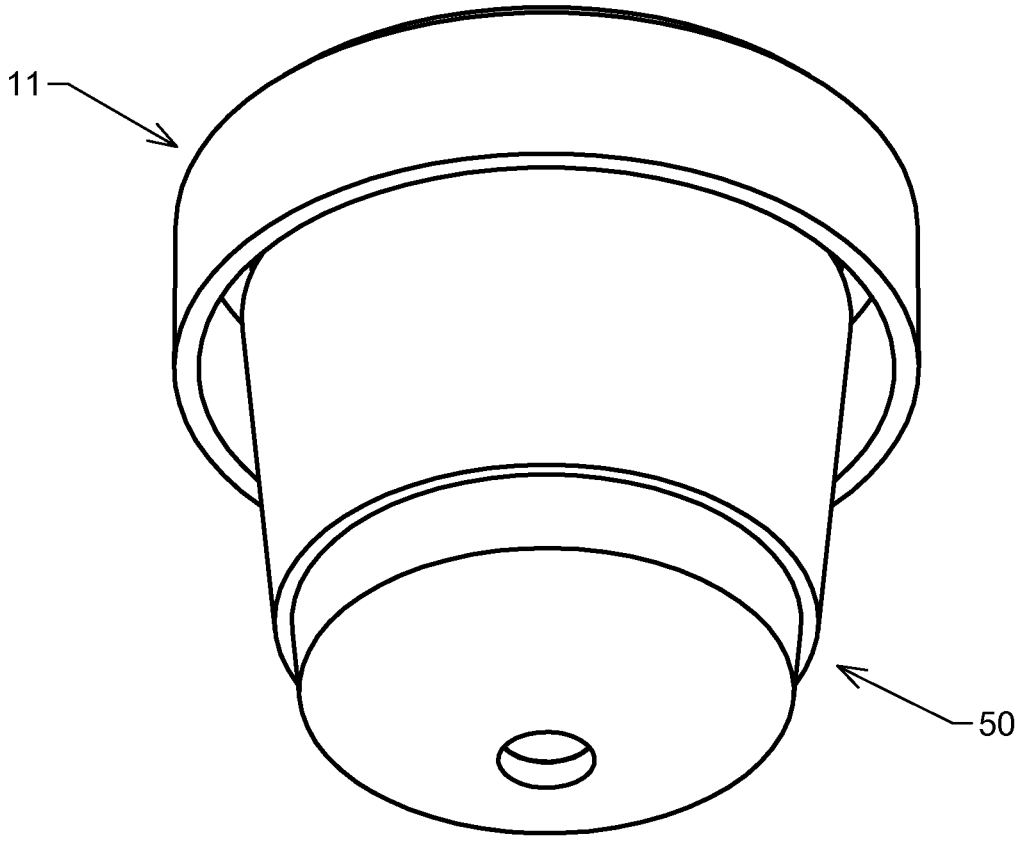
FIG. 9 is a right side perspective of the bottom of an exemplary embodiment of the Cup assembled together with the Large and Small Half Mold assembly.
Figure 10:
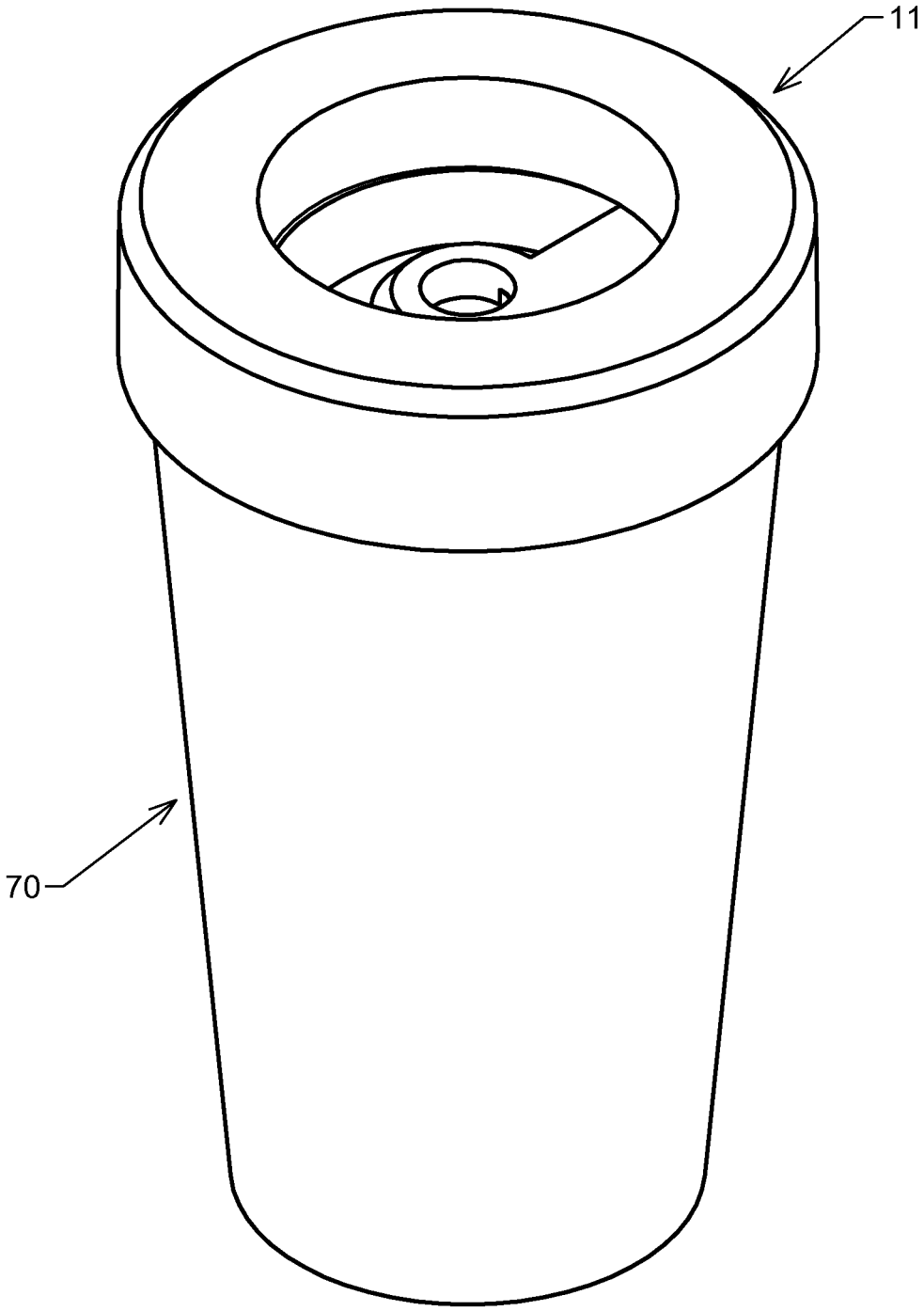
FIG. 10 is a right side view of the bottom of an exemplary embodiment of the Insulated Vessel assembled together with the Cup and the Large and Small Half Mold assemblies.

FIGS. 8-10 illustrate how exemplary embodiments of the parts are assembled into an exemplary embodiment of the device. FIG. 8 shows small half mold 30 mated with large half mold 11 at outer flange 15 to form a cylindrical outer shape below cap 16 with a spherical cavity inside the cylinder. Outer flange 15 interlocks with inner flange 32. FIG. 9 shows small half mold 30 mated with large half mold 11 and inserted into cup cavity 51. FIG. 10 shows small half mold 30 mated with large half mold 11, inserted into cup cavity 51 and then inserted into insulated vessel cavity 71.

Operation

Operation of the device requires assembly of the device, filling and freezing a liquid in the device, and finally extraction of the clear ice ball.

Assembly of the device is illustrated in FIGS. 8-10. Small half mold 30 is pressed together with large half mold 11 such that outer flange 15 interlocks with inner flange 32. The material flexibility of small half mold 30 allows it to snap into place with minimal effort. Holding cap 16, the cylindrical shape created by mating the two half molds is pressed down into cup cavity 51 until the top of cup 50 reaches the underside of cap 16. Finally the half molds and cup 50 are pressed down into insulated vessel cavity 71 until the top of insulated vessel 70 reaches the bottom of cap 16.

With the device assembled it can be filled with liquid, typically water, but any liquid that will freeze at normal freezer temperatures (e.g. 0 degrees Fahrenheit) may be used. The liquid may be slowly poured into large half mold fill hole 12 until it rises above the hole and into overflow cavity 18. The filled vessel may be shaken, tapped or otherwise agitated to release trapped air; additional liquid may need to be added if the liquid level drops below large half mold fill hole 12 after any air is released. Once filled the device is submitted to temperatures below the freezing point of the liquid. Insulated vessel 70 prevents the liquid from freezing on all sides which would trap gases and impurities. Only the top of the device is unprotected from the freezing temperatures thus the liquid freezes from the top down with liquid at the bottom of insulated vessel 70 freezing last. This forces gases and impurities down out of the spherical cavity through the exit holes and into the unfrozen liquid leaving a crystal clear ice sphere in the spherical cavity and a mass of cloudy ice in the lower section of insulated vessel cavity 71.

Once the liquid in the spherical mold cavity is frozen the clear ice sphere may be removed. First the two half molds and cup 50 are removed. This is accomplished by either lifting the assembly out of insulated vessel 70 by cap 16 or by rotating cap 16 while keeping insulated vessel 70 fixed to break cup 50 free from ice formed in the lower section of insulated vessel 70. Warm liquid may be used to expedite or ease this extraction. Next the two half molds may be removed from cup 50 by either lifting them out by cap 16 or by again rotating cap 16 while fixing cup 50 to break the half molds free from any ice formed between cup 50 and the two half molds. Again warm liquid may be used to expedite or ease this extraction. Lastly small half mold 30 is removed from large half mold 11 by pulling small half mold 30 away starting from large half mold 11 at small half mold exit hole 33. Again warm liquid may be used to expedite or ease this extraction. The clear ice sphere may now be removed from the device.

Alternative Embodiments

One exemplary additional embodiment removes cup 50 from the device and modifies the shape of insulated vessel cavity 71 to conform to the shape of the two half molds mated together (a cylinder in the exemplary embodiment illustrated in FIG. 8). The operation of the device remains unchanged excepting the steps involving cup 50.

Other embodiments of small half mold 30 and large half mold 11, which are oriented vertically when mated in the exemplary embodiment illustrated in FIG. 8, may be oriented horizontally or at any other angle when mated.

CONCLUSION

Accordingly the reader will see that the exemplary embodiments can create clear ice using a top down freezing method and can produce clear ice spheres, all without complex or expensive equipment.

Although the description above contains many specificities, these should not be construed as limiting the scope of the embodiments, but as merely providing illustrations of some of several embodiments. For example, cap 16 may have a different shape such as square, triangle, etc.; the half molds may mate vertically, horizontally, or at some angle in between; cup 50 may be removed, etc.

Thus the scope of the embodiments should be determined by the appended claims and their legal equivalents, rather than by the examples given.

We claim:

1. A device for producing a piece of ice when the device is placed in a freezing environment, wherein the piece of ice has a shape, the device comprising:

an insulating vessel designed and configured to be placed into the freezing environment, the insulating vessel having an interior, an upper portion, and a lower portion and including an opening in the upper portion;

a mold designed and configured to be removably installed into the insulating vessel via the opening each time the device is used to make the piece of ice, the mold:

having an upper end and a lower end spaced from the upper end;

defining a hollow void between the lower end of the mold and the interior of the insulating vessel when mold is installed in the insulating vessel during use of the device;

defining a cavity between the upper and lower ends and having the shape of the piece of ice, the cavity designed and configured to receive a liquid to be frozen into the piece of ice during use of the device;

including an exit hole at the lower end, the exit hole designed and configured to place the cavity of the mold into communication with the hollow void so as to allow the liquid to flow into the hollow void from the cavity of the mold during use of the device; and including a fill opening in the upper end, the fill opening designed and configured to allow the liquid to flow into the cavity of the mold, wherein the fill opening is used to fill the hollow void and the cavity with the liquid during use of the device to make the piece of ice; and a cup designed and configured to:

receive the mold so as to laterally constrain the mold during use of the device;

be inserted into the insulating vessel during use of the device; and include an opening in registration with the exit hole of the mold so as to allow the exit hole to fluidly communicate with the hollow void;

wherein the cup has a substantially cylindrical interior and the mold has a like-shaped exterior designed and configured to confront the cylindrical interior when the mold is fully engaged with the cup.

2. The device according to claim 1, wherein the cavity is spherical.

3. The device according to claim 1, wherein the mold is a split mold having a vertical split when the device is deployed in the freezing environment.

4. The device according to claim 3, wherein the mold includes a first mold half and a second mold half that join at the vertical split.

5. The device according to claim 4, wherein the mold further comprises a top portion that fully remains with the first mold half when the second mold half is disengaged from the first mold half.

6. The device according to claim 1, wherein the insulating vessel has a rim around the opening and the mold includes a lip engaging the rim of the vessel during use of the device.

7. The device according to claim 1, wherein the cavity is spherical.

8. The device according to claim 1, wherein the mold includes an overflow region adjacent the fill opening, the overflow region designed and configured to contain an overflow of the liquid during filling of the hollow void and cavity.

9. The device according to claim 1, wherein the cavity has a lowest point when the device is deployed for use and the exit hole is located at the lowest point of the cavity.

10. The device according to claim 1, wherein the fill opening comprises a hole in the mold.

11. The device according to claim 1, wherein, during deployment of the device to make the piece of ice, the upper end of the mold is directly exposed to the freezing environment and the lower end of the mold and hollow void are insulated from the freezing environment by the insulating vessel.

12. A method of making a piece of clear ice having a shape, the method comprising:

providing a cavity having the shape of the piece of ice;

providing a hollow void adjacent to the cavity and in fluid communication with the cavity;

adding a clear liquid to the cavity so as to fill the hollow void and the cavity;

causing the clear liquid to directionally freeze from a location distal from the hollow void toward the hollow void so as to drive air and/or impurities in the clear liquid from the cavity and into the clear liquid in the hollow void so as to form the piece of clear ice in the cavity;

overfilling the cavity with the clear liquid so as to create overfill and causing the overfill to freeze into frozen overfill.

13. The method according to claim 12, wherein causing the clear liquid to directionally freeze includes creating cloudy ice in the hollow void.

14. The method according to claim 13, further comprising separating the piece of clear ice from the cloudy ice.

15. The method according to claim 12, wherein causing the clear liquid to directionally freeze includes insulating the cavity and hollow void except at the location distal from the hollow void.

16. The method according to claim 15, wherein causing the clear liquid to directionally freeze includes placing a device containing the cavity and hollow void, each of which contains the clear liquid, into a freezer.

17. The method according to claim 12, further comprising removing the frozen overfill from the piece of clear ice.

* * * * *